United States Patent [19]

Lyon et al.

[11] 3,987,653

[45] Oct. 26, 1976

[54] LOOPED CABLE LOCKING DEVICE

[76] Inventors: Reginald Lyon, 74 Tulane Crescent, Scarborough, Ontario; Kenneth Winter, R.R. No. 1, Kettleby, King Township, Ontario; Hugh O'Neill, 172 McNicholl Ave., Willowdale, Ontario, all of Canada

[22] Filed: Nov. 6, 1975

[21] Appl. No.: 629,496

[52] U.S. Cl. ..... 70/19; 70/49

[51] Int. Cl.[2] ..... E05B 73/00

[58] Field of Search ..... 70/14, 15, 18, 19, 30, 70/49, 360

[56] References Cited

UNITED STATES PATENTS

| | | | |
|---|---|---|---|
| 1,520,902 | 12/1924 | Junkune | 70/49 |
| 1,971,797 | 8/1934 | Shinn | 70/19 X |
| 2,469,592 | 5/1949 | Byer | 70/15 X |
| 3,841,118 | 10/1974 | Stone | 70/33 |

*Primary Examiner*—Robert L. Wolfe

[57] ABSTRACT

A locking device for a looped cable includes a casing in which one end of the cable is anchored, there being a passageway through the casing through which the other end of the cable can be passed. Within the casing is a cable clamp for reducing the size of the passageway, the clamp being threaded on a screw and movable to change the size of the passageway by rotation of the screw. The screw is rotatable by rotation of a lock mounted in the casing, the lock being rotatable by a key. The clamp cooperates with a bed to define the passageway, the clamp and bed having intercalated pyramidal teeth which can exert a vise-like grip on a cable of normally cylindrical shape.

8 Claims, 5 Drawing Figures

LOOPED CABLE LOCKING DEVICE

BACKGROUND OF THE INVENTION

1. Field of the Invention

This invention relates to a looped cable locking device.

2. Description of the Prior Art

Devices are known wherein the size of a loop defined by a cable can be varied and the cable can be locked when the loop is of a desired size.

SUMMARY OF THE INVENTION

The present invention provides such a device that can be of simple, economical, trouble free construction and provides an effective lock that may be operable only with a key. According to the invention, a looped cable locking device comprises a casing having a bed, a flexible cable outside the casing but having one end anchored at the casing and having another portion movable longitudinally across the bed, and means for fixing the longitudinal position of said portion of the cable relative to the bed, said means comprising a clamp threadably mounted on a screw and movable towards and away from the bed by rotation of the screw, the screw being rotatable by rotation of a lock supported by the casing, and the casing having a guideway which prevents rotation of the clamp with the screw.

BRIEF DESCRIPTION OF THE DRAWINGS

A preferred embodiment of the invention is illustrated by way of example in the accompanying drawings in which.

DESCRIPTION OF THE PREFERRED EMBODIMENT

Figure 1:
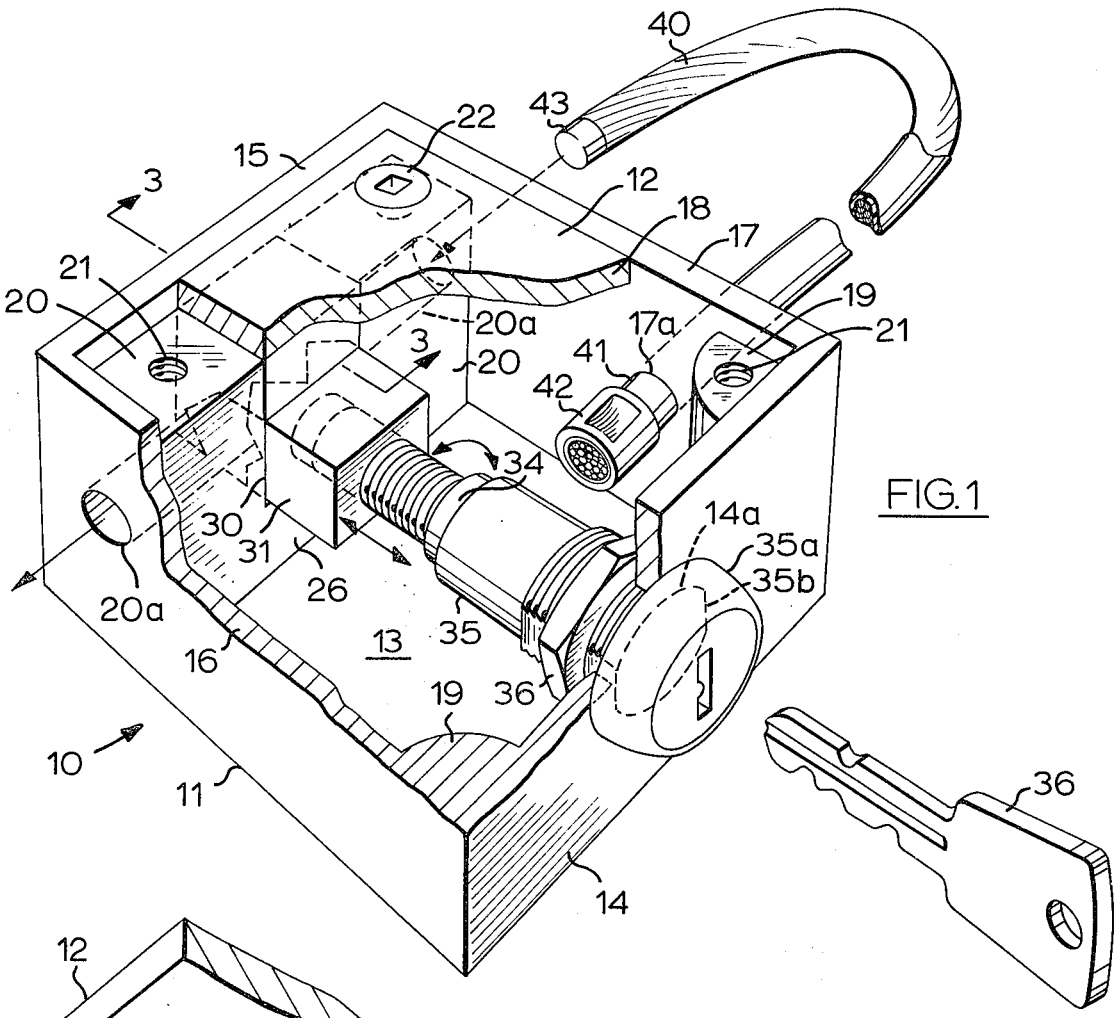
FIG. 1 is a broken away perspective view of a looped cable locking device and a key therefor.

Referring to FIG. 1, a box-like metal casing 10 consists of a lower part 11 and an upper part 12 that closes the casing. The lower part 11 has a bottom wall 13, a front wall 14, a rear wall 15 and side walls 16 and 17. The upper part has a top wall 18 that can nest between the walls 14, 15, 16 and 17, resting on fillets 19 at the front corners and on rectangular pillars 20 at the rear corners, the fillets and pillars having tapped holes 21 to receive screws 22 which fasten the top wall 18 in place.

Figure 2:
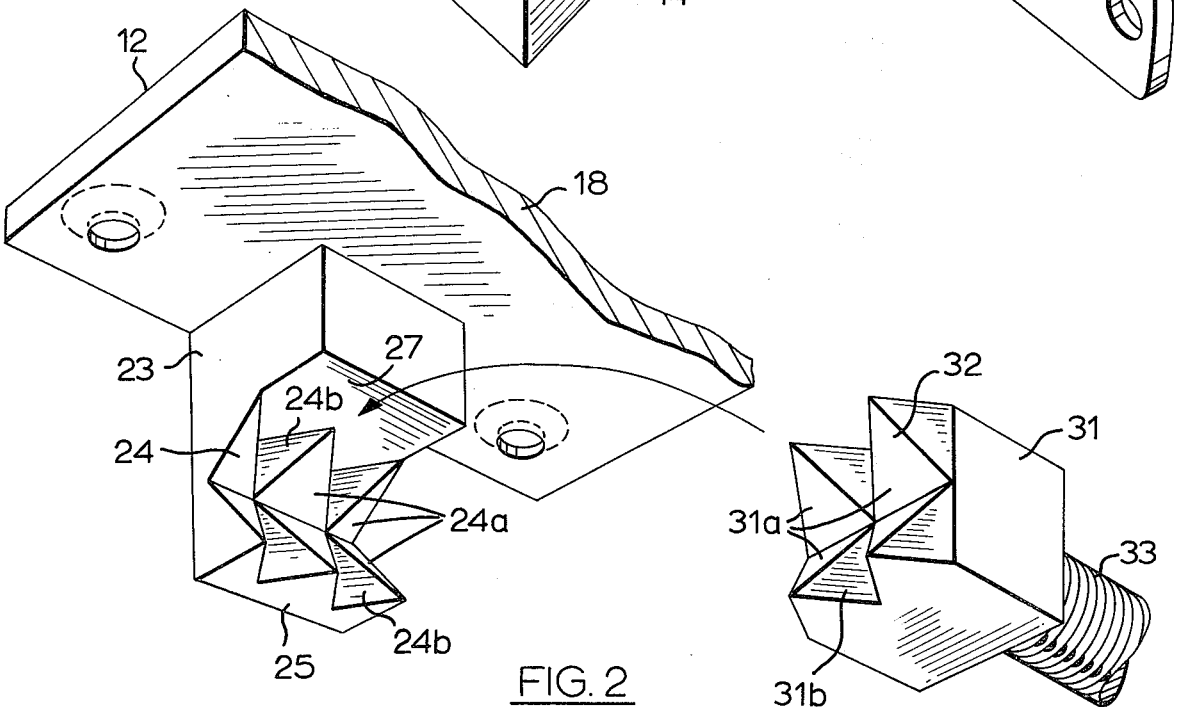
FIG. 2 is a perspective view of parts of the locking device that fit together to grip the cable between them.

As best seen in FIG. 2, the upper part 12 of the casing has, depending from the top wall 18, a rectangular lug 23, and this fits snugly between the rectangular corner pillars 20 of the lower part 11. Integral with the lug 23 is an irregularly faced bed 24, described more fully below, with a plane lower surface 25 that fits against a platform 26 (FIG. 3) that extends between the pillars 20. The underside 27 of the lug 23, the platform 26, and side surfaces of the pillars 20 define a rectangular recess or guideway 30 in which is slidable a clamping nut 31 that is rectangular save for an irregular face 32 that is complementary to the irregular face of the bed 24. The nut 31 is threadably mounted on a screw 33, rotation of the screw causing the clamping nut to advance or retract in the guideway 30, the guideway preventing rotation of the nut.

Figure 5:
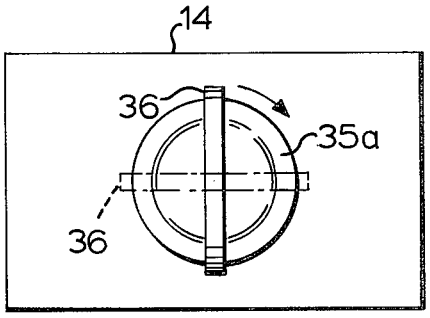
FIG. 5 is an end view of the device shown in FIG. 3 and indicating two positions at which the key may be inserted or removed.

The screw 33 is affixed to the rotatable tumbler 34 of a conventional key-operated lock. The body 35 of the lock is affixed in an opening **14*a* in the front wall 14 by means of a nut 36 that threads onto the body 35 and holds the head 35*a* of the lock body against the wall 14. The lock body 35 has flats 35*b* that register with corresponding flats of the opening 14*a* to prevent rotation of the lock body 35 in the opening 14*a*. When a key 36 is inserted into the lock, the tumbler 34 and screw 33 can be rotated by the key to advance or withdraw the clamping nut 31 into or from the guideway 30. When the key is withdrawn from lock, pins in the lock prevent rotation of the tumbler 34 and screw 34 relative to the stationary lock body 35. Preferably the lock is of a type which will allow the key to be withdrawn after rotation through 90°, i.e., when in either the full line or broken line positions of FIG. 5, so that the clamping nut 31 can, between locking positions, be advanced into the guideway 30 by increments corresponding to a quarter turn of the screw 33**.

Outside the casing 10 is a flexible cable 40. One end 41 of the cable extends through an opening **17*a* in the side wall 17 and is anchored in the casing by a ring 42 affixed to the end 41 and larger than the opening 17*a*. The other end 43 of the cable can be passed through a cylindrical hole 20*a* drilled through the casing 10 and passing transversely through the pillars 20. The portion of the cable that is passed through the hole 20*a* extends across the irregular face of the bed 24 but the cable is freely movable longitudinally as long as the clamping nut 31 is not tightened against it. However the longitudinal position of the cable relative to the bed can be fixed by moving the clamping nut 31 along the guideway 30 towards the bed so as to grip the cable between the clamping nut and the bed, thereby fixing the size of the cable loop outside the casing 10**.

Figure 3:
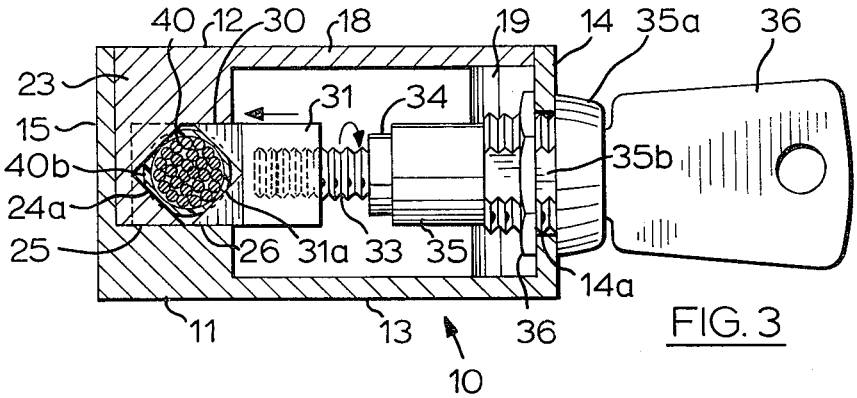
FIG. 3 is a sectional view taken along the line 3—3 of FIG. 1, with the key inserted and the cable passed between the parts shown in FIG. 2.
Figure 4:
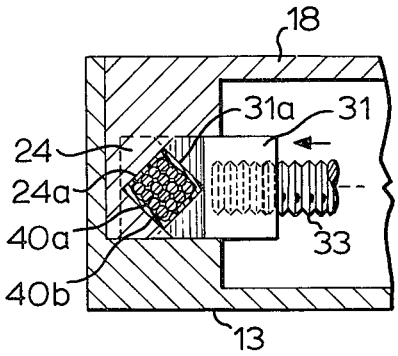
FIG. 4 is a similar sectional view of parts shown in FIG. 3 but moved to grip the cable.

As best seen in FIGS. 3 and 4, the bed 24 and nut 31 have concave, V-shaped frontal surfaces **24*a*, 31*a* for engaging the cable 40, these frontal surfaces defining a cable passage of variable cross-sectional size as the clamping nut is moved relative to the bed. The cable passage illustrated is of square cross-sectional shape, whereas the cable, at least when undeformed by the gripping action, is of circular cross-section. The cable preferably has multiple metal strands 40*a* which can move relatively to one another in response to pressure exerted upon them by movement of the clamping nut 31 towards the bed 24. Thus, the cross-sectional shape of the cable can be deformed in the locality of the passage between the bed and the clamp, making withdrawal of the cable very difficult. However the strands should be resilient so as to restore the cable to its undeformed, circular cross-section when the pressure of the clamp 31 is released. Preferably also the cable 40 has a tough, deformable plastic sheath 40*b* which protects the strands 40*a*** against damage by the gripping action of the bed and clamp. In one example, the cable used is a 133 strand galvanized aircraft cable having a polyethylene coating 1/16 inch thick, but the locking device may of course be made in a variety of sizes to accommodate cables of different sizes.

To ensure that the cable is completely surrounded by the frontal surfaces of the bed and clamp, and to increase further the gripping action, the V-shaped frontal surfaces 24*a*, 31*a* are transversed by V-shaped vertical grooves 24*b*, 31*b*, the resultant irregular surfaces of the bed and clamp defining pyramidal teeth, the teeth meshing or intercalating as the clamp is advanced towards the bed, the teeth of each entring the vertical grooves of the other. The pyramidal ridges increase the frictional grip of the bed and clamp on the cable.

Modifications of the preferred embodiment herein described will readily occur to those skilled in the art, and are intended to be covered by the subjoined claims.

What we claim is:

1. A looped cable locking device comprising a casing having a bed, a flexible cable outside the casing but having one end anchored at the casing and having another portion movable longitudinally across the bed, and means for fixing the longitudinal position of said portion of the cable relative to the bed, said means comprising a clamp threadably mounted on a screw and movable towards and away from the bed by rotation of the screw, the screw being rotatable by rotation of a lock supported by the casing, and the casing having a guideway which prevents rotation of the clamp with the screw.

2. A device as claimed in claim 1, wherein the screw and lock can be rotated only by a key insertable into the lock, the key being removable when the cable has been gripped between the bed and the clamp.

3. A device as claimed in claim 2, wherein the bed and clamp have concave frontal surfaces for engaging the cable, the frontal surfaces defining a cable passage of variable cross-sectional size as the clamp is moved relative to the bed.

4. A device as claimed in claim 3, wherein the cable passage is of different cross-sectional shape than the cable.

5. A device as claimed in claim 4, wherein the cable has multiple strands and is deformable in cross-section by relative movement of the strands in response to pressure exerted upon them by movement of the clamp towards the bed, the strands being resilient to restore the cable to its undeformed cross-section when such pressure is released.

6. A lock as claimed in claim 5, wherein the cable when undeformed is of circular cross-section and has a deformable protective sheath.

7. A device as claimed in claim 1, wherein the bed and clamp have intercalated teeth which allow the clamp to move towards and away from the bed.

8. A device as claimed in claim 1, wherein the bed and clamp have intercalatable pyramidal teeth the frontal surfaces of which define a cable passage of square cross-section.

* * * * *